US007967383B2

(12) United States Patent
LaPointe

(10) Patent No.: US 7,967,383 B2
(45) Date of Patent: Jun. 28, 2011

(54) FURNITURE MEMBER SWIVEL BASE

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 754 days.

(21) Appl. No.: 11/897,602

(22) Filed: Aug. 31, 2007

(65) Prior Publication Data

US 2009/0057519 A1 Mar. 5, 2009

(51) Int. Cl.
*A47C 1/00* (2006.01)
*A47B 91/00* (2006.01)

(52) U.S. Cl. ..... 297/344.26; 248/349.1

(58) Field of Classification Search ..... 297/344.26, 297/344.21; 248/349.1, 415
See application file for complete search history.

(56) References Cited

U.S. PATENT DOCUMENTS

| | | | | |
|---|---|---|---|---|
| 4,400,032 | A | 8/1983 | dePolo | |
| 4,549,714 | A * | 10/1985 | Busch | 248/349.1 |
| 4,607,897 | A | 8/1986 | Schwartz | |
| 4,635,894 | A | 1/1987 | Sammons | |
| 4,637,666 | A | 1/1987 | Worrell et al. | |
| 4,844,543 | A * | 7/1989 | Ochiai | 297/344.26 |
| 5,120,107 | A | 6/1992 | Rogers, Jr. | |
| 5,503,086 | A | 4/1996 | Hoffman et al. | |
| 5,507,044 | A | 4/1996 | Williamson et al. | |
| 5,549,052 | A | 8/1996 | Hoffman | |
| 5,580,129 | A | 12/1996 | Findlay | |
| 5,593,461 | A | 1/1997 | Reppert et al. | |
| 5,810,441 | A * | 9/1998 | Ezuka et al. | 297/344.26 |
| 6,021,989 | A * | 2/2000 | Morita et al. | 248/349.1 |
| 6,048,029 | A | 4/2000 | Percoco | |
| 6,099,093 | A | 8/2000 | Spence | |
| 6,120,101 | A | 9/2000 | Zimmerman | |
| 6,273,531 | B1 | 8/2001 | Scheffer | |
| 6,315,360 | B1 | 11/2001 | Guerrini | |
| 6,588,059 | B1 | 7/2003 | McCord | |
| 6,604,737 | B1 | 8/2003 | Garrett | |
| 7,065,828 | B2 | 6/2006 | Sorensen | |
| 7,140,685 | B2 | 11/2006 | Gardner | |

FOREIGN PATENT DOCUMENTS

| | | |
|---|---|---|
| JP | 10-000131 | 1/1998 |
| JP | 3085400 | 2/2002 |
| KR | 87-3430 | 3/1987 |

* cited by examiner

*Primary Examiner* — Milton Nelson, Jr.
(74) *Attorney, Agent, or Firm* — Harness, Dickey & Pierce, P.L.C.

(57) ABSTRACT

A furniture member swivel base includes a hollow first ring having L-shaped walls, including an outer wall vertically oriented and a ball contact wall horizontally oriented in an operating position. A hollow second ring includes ball bearing cavities proximate a second ring outer perimeter. The second ring is positioned below the first ring in the operating position. A ball bearing is rotatably received in each of the ball bearing support cavities and extends partially above the second ring to rotatably support the ball contact wall and permit the first ring to rotate with respect to the second ring. The first ring is fixed to the furniture member so the furniture member is supported on the first ring. The furniture member and the first ring are rotatable about an axis oriented transverse to the second ring with the second ring non-rotatably in contact with a floor surface.

11 Claims, 11 Drawing Sheets

FIG 13
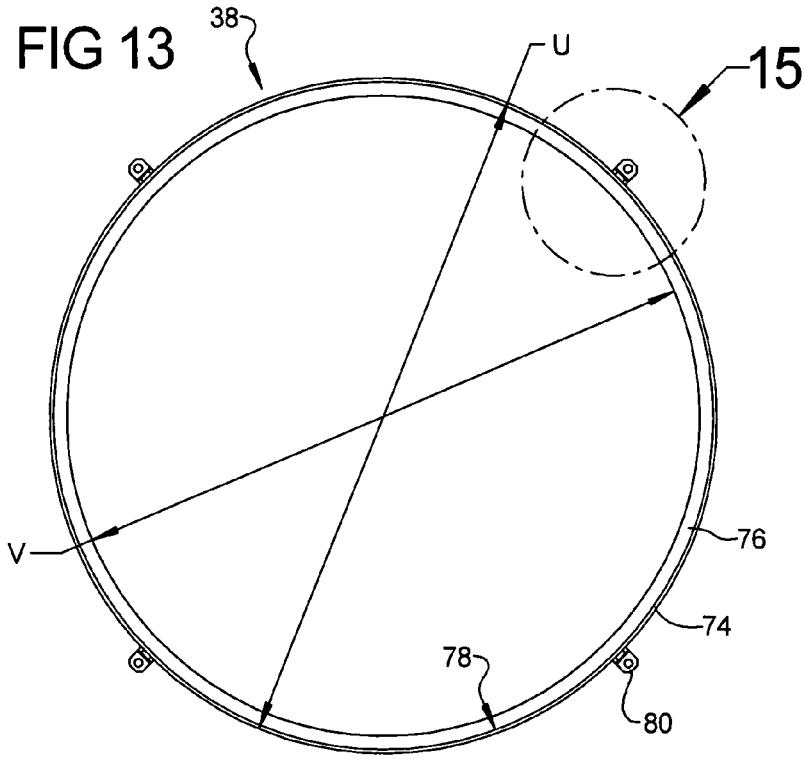
FIG 14
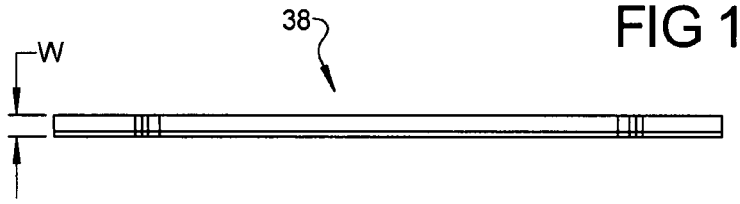
FIG 16
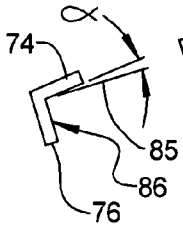
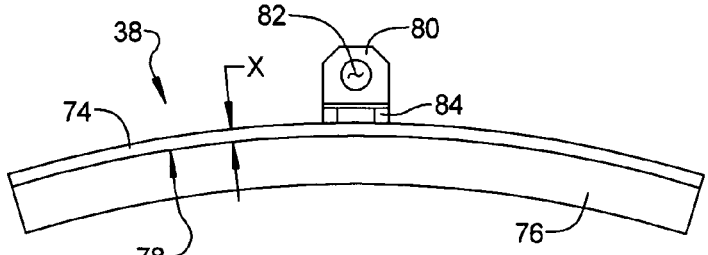
FIG 15

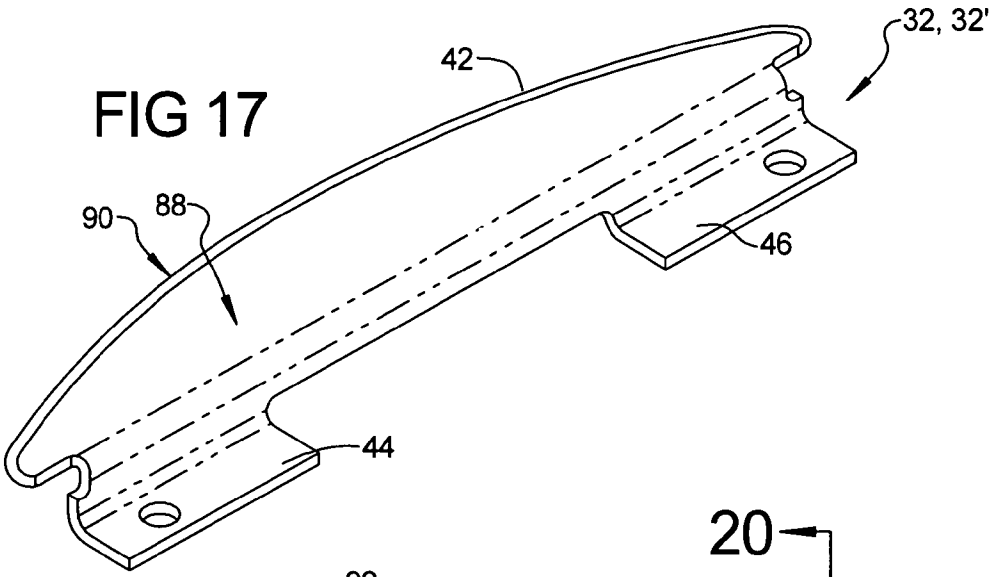
FIG 17
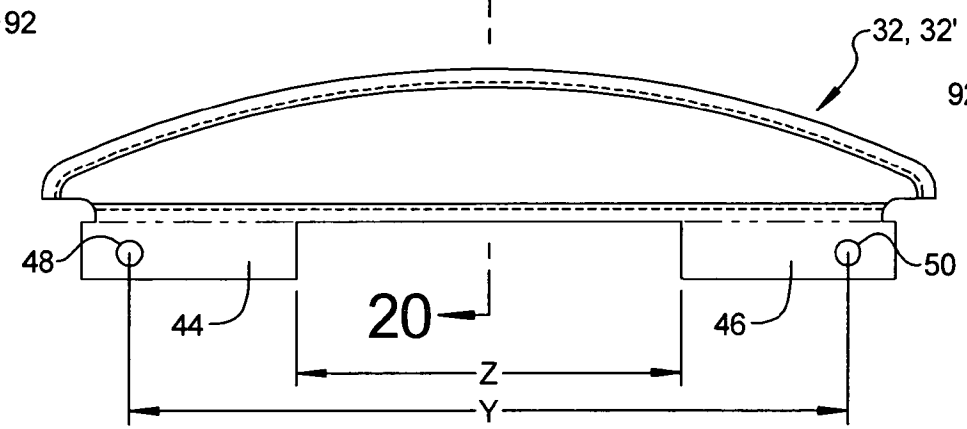
FIG 18
FIG 19
FIG 20

FURNITURE MEMBER SWIVEL BASE

FIELD

The present disclosure relates to a swivel member for a furniture member and a method for supporting a furniture member.

BACKGROUND

The statements in this section merely provide background information related to the present disclosure and may not constitute prior art.

Conventionally, reclining articles of furniture (i.e., chairs, sofas, loveseats, and the like) require a mechanism to bias a leg rest assembly in the extended and stowed positions. Most reclining rocking chairs include an upholstered chair frame supported from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed or retracted) and elevated (i.e., extended or protracted) positions.

When a rotating motion is also desired, common furniture member mechanisms add a swivel member having opposed metal plates with metal ball bearings disposed between the plates. A first one of the plates is connected to the mechanism and the second plate is connected to an upper member of a leg or support frame of the furniture member. A plurality of ball bearings is commonly located in a continuous circular slot or groove created in one or both of the plates. Disadvantages of known swivel members include the cost and weight of the swivel member, and a limited diameter of approximately 8 to 10 inches (20.3 to 25.4 cm) to allow the swivel member to fit in the space envelope of the frame and mechanism. The moment arm created when an occupant extends the leg rest assembly or rotates a seat back member can over-stress the swivel member. Swivel members are therefore not known in "wall proximity" furniture members due to the additional moment arm created by translation of the mechanism, which can overstress the swivel member. In addition, it is difficult and expensive to back-fit known swivel members into an existing furniture member because the furniture member support frame and often multiple parts of the mechanism must be removed to insert the swivel member.

SUMMARY

According to several embodiments of the present disclosure a swivel base for a furniture member includes hollow first and second rings having a plurality of ball bearings positioned between the first and second rings to operably permit the first ring to rotate with respect to the second ring. The first ring is adapted to be fixedly connected to the furniture member such that the furniture member is supported on the first ring, the furniture member and the first ring being rotatable with respect to the second ring when the second ring is non-rotatably and directly in contact with and supported on a floor surface.

According to further embodiments, a swivel base for a furniture member includes a hollow first member having walls defining an L-shape, the walls including an outer wall oriented substantially vertically in an operating position and a ball contact wall oriented substantially horizontally in the operating position. A hollow second member has a plurality of ball bearing support cavities proximate to an outer perimeter of the second member. The second member is positioned below the first member in the operating position. A ball bearing is rotatably received in each of the ball bearing support cavities and extends partially above the second member to rotatably support the ball contact wall of the first member and permit the first member to rotate with respect to the second member. The first member is adapted to be fixedly connected to the furniture member, with the furniture member supported on the first member. The furniture member and the first member are rotatable about an axis oriented substantially transverse to the second member with the second member non-rotatably in contact with and supported on a floor surface.

According to still further embodiments, a furniture member includes a frame supported by a support frame assembly. A swivel base includes a hollow first ring having walls defining an L-shape, the walls including an outer wall and a ball contact wall, the first ring being fixedly connected to the support frame assembly. A hollow second ring has a plurality of ball bearing support cavities proximate to an outer perimeter of the second ring and a diametrically formed slot positioned radially outward of the cavities. The second ring is positioned below the first ring and the slot is adapted to rotatably receive the outer wall. A ball bearing is rotatably received in each of the ball bearing support cavities and extends partially above the second ring to rotatably support the ball contact wall of the first ring and permit the first ring and the furniture member to rotate with respect to the second ring.

According to still further embodiments, a method for rotatably supporting a furniture member includes creating a hollow first ring having walls defining an L-shape; installing a hollow second ring having a plurality of ball bearing support cavities proximate to an outer perimeter of the second ring under the first ring; rotatably disposing a ball bearing in each of the ball bearing support cavities whereby each ball bearing extends partially above the second ring to permit the first ring to rotatably contact each ball bearing such that the first ring can rotate with respect to the second ring; fixing the first ring to a furniture member such that the furniture member and the first ring are rotatably supported with respect to the second ring; and positioning the second ring in contact with a floor surface such that the second ring is non-rotatably supported by the floor surface.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 13 is a bottom plan view of a cap ring of the swivel base;

FIG. 14 is a side elevational view of the cap ring of FIG. 13;

FIG. 15 is a partial top plan view taken at area 15 of FIG. 13;

FIG. 16 is an end elevational view of the cap ring of FIG. 15;

FIG. 17 is a top perspective view of a support bracket of the present disclosure;

FIG. 18 is a top plan view of the support bracket of FIG. 17;

FIG. 19 is a side elevational view of the support bracket of FIG. 17;

FIG. 20 is a cross sectional side elevational view taken at section 20 of FIG. 18;

DETAILED DESCRIPTION

Figure 1:
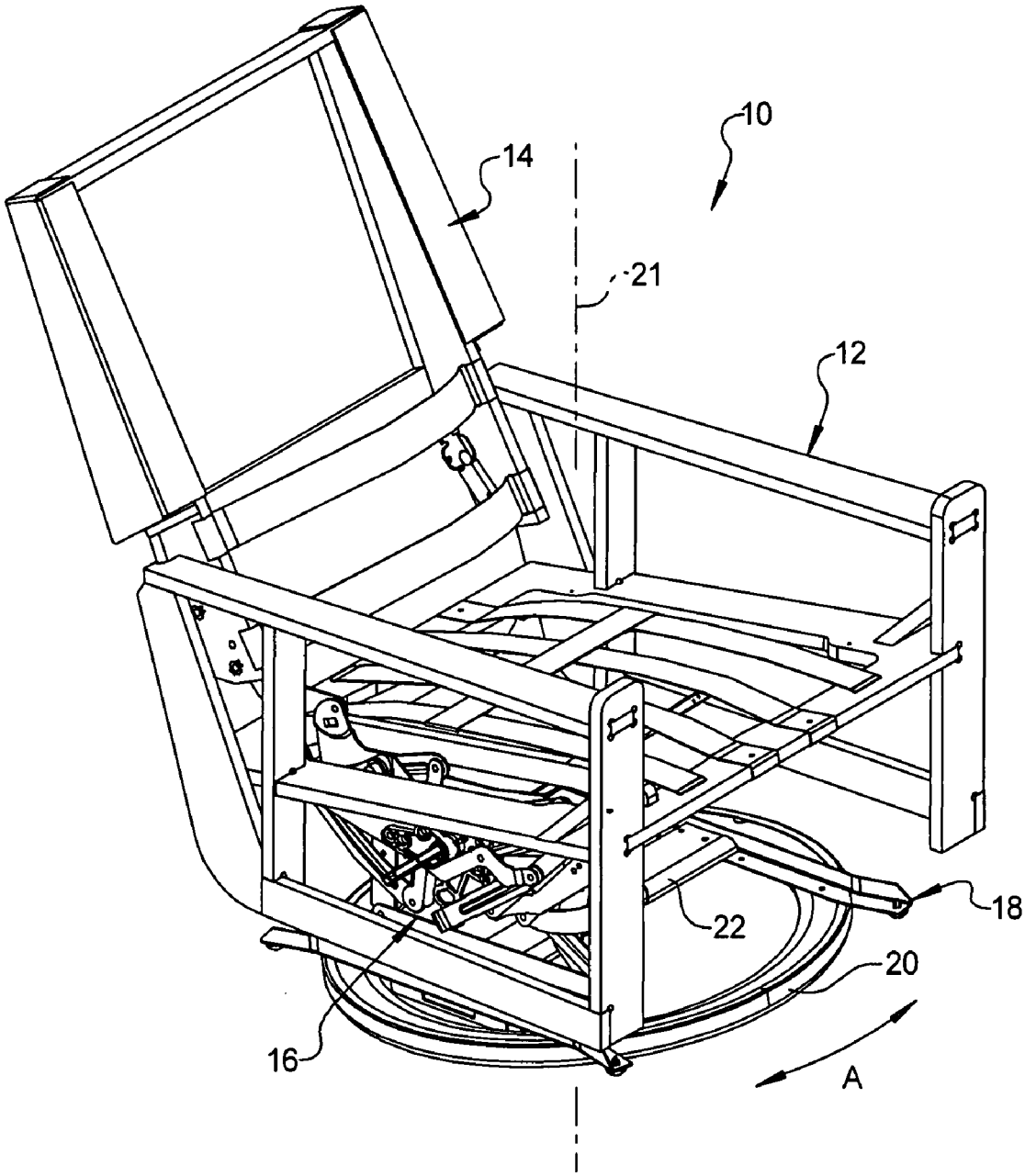
FIG. 1 is a front perspective view of a furniture member having a furniture member swivel base of the present disclosure.

The following description is merely exemplary in nature and is not intended to limit the present disclosure, application, or uses. It should be understood that throughout the drawings, corresponding reference numerals indicate like or corresponding parts and features.

Referring generally to FIG. 1, a furniture member 10 includes a frame 12 and a back support member 14. Furniture member 10 is depicted as a rocking, reclining chair, however furniture member 10 can be any type of occupant support member including but not limited to sofas, ottomans, loveseats, sectional assemblies, and the like. According to several embodiments, back support member 14 can be rotatable with respect to frame 12. A mechanism 16 is positioned within and connects to frame 12 and provides multiple functions such as a rocking and/or a reclining motion for furniture member 10. According to several embodiments, mechanism 16 is adapted to provide at least one of a rocking, a legrest extension, and a backrest tilting function. According to additional embodiments, mechanism 16 is a wall proximity mechanism adapted to provide a wall proximity position of furniture member 10. Mechanism 16, back support member 14 and frame 12 are each supported from a support frame assembly 18. Support frame assembly 18 is in turn fixedly connected to a swivel member or base 20 such that furniture member 10 is rotatable 360 degrees about an arc of rotation "A" which is defined about an axis 21 oriented perpendicular to swivel base 20.

According to several embodiments, a biasing member 22 can also be provided which is adaptable to allow furniture member 10 to rock forward and backward with respect to an occupant in furniture member 10. Swivel base 20 is supportable directly from and in contact with a floor or ground surface such that an entire perimeter of swivel base 20 is supported from the floor surface. The floor surface can be any substantially flat item, including but not limited to tile, wood, carpeting, vinyl, concrete, and the like materials commonly used as flooring material.

Figure 2:
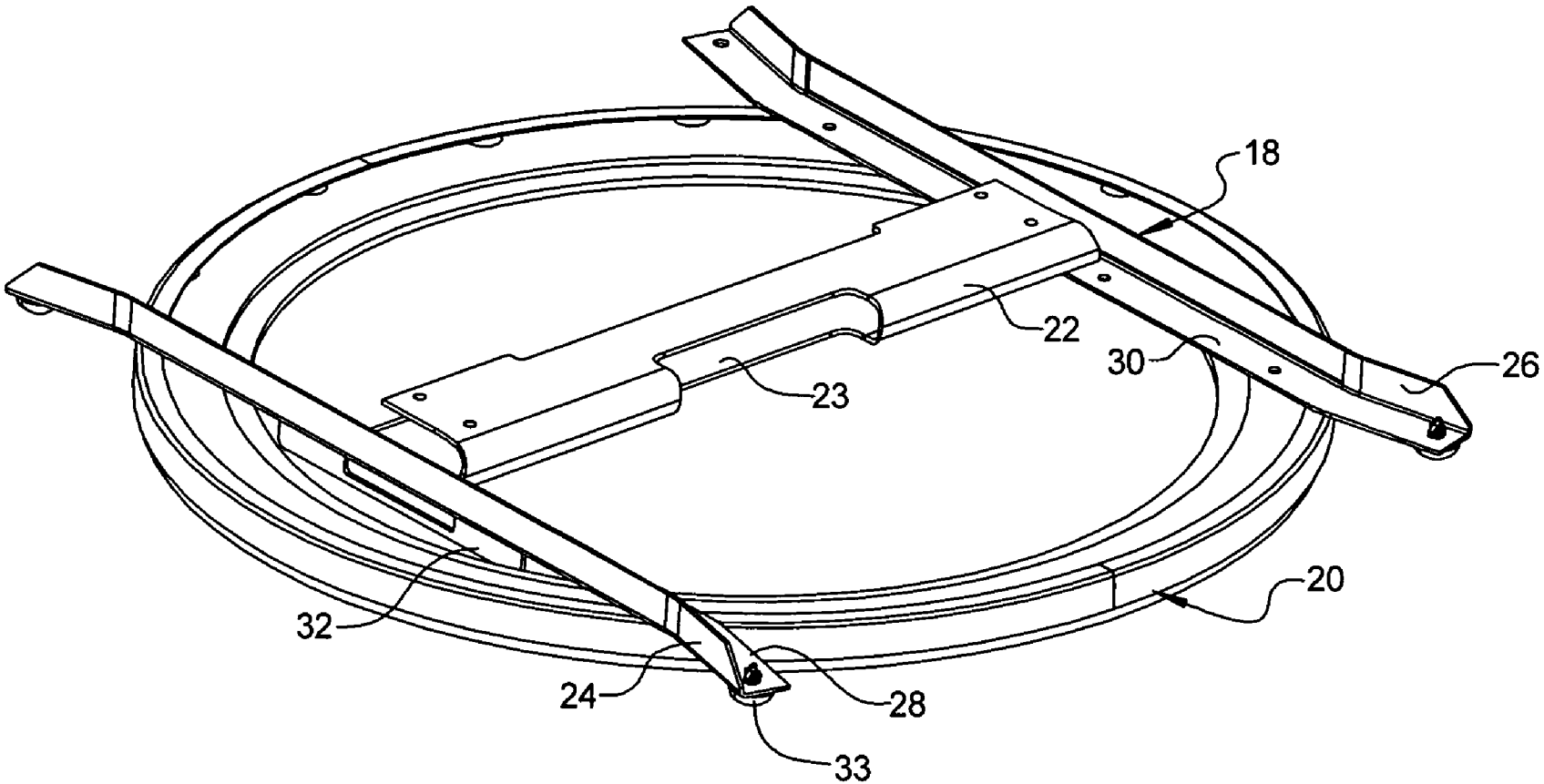
FIG. 2 is a front perspective view of an assembly of a support frame assembly of the furniture member of FIG. 1 with the swivel base.

Referring now to FIG. 2, support frame assembly 18 is shown in greater detail in reference to swivel base 20. Biasing member 22 permits a rocking motion of furniture member 10 can be shaped as a U-shaped spring having a connecting member 23 which is connected to each of a first and second frame leg 24, 26 of support frame assembly 18. Biasing member 22 can also be one or more coiled springs (not shown) connected to first and second frame legs 24, 26. Connecting member 23 can be fastenably connected to a first leg flange 28 of first frame leg 24 and also to a second leg flange 30 of second frame leg 26. A pair of support brackets 32 (only one of which is clearly visible in FIG. 2) is also provided to connect first and second frame legs 24, 26 to swivel base 20 such that furniture member 10 is prevented from vertically lifting away from swivel base 20, while still being able to rotate using swivel base 20. Support frame assemblies 18 often provide multiple foot members 33, which can extend to a height of approximately ½ inch (1.27 cm) or greater. Swivel base 20 occupies a portion of the vertical space envelope of foot members 33, therefore reducing the height impact of adding swivel base 20 to furniture member 10.

Figure 3:
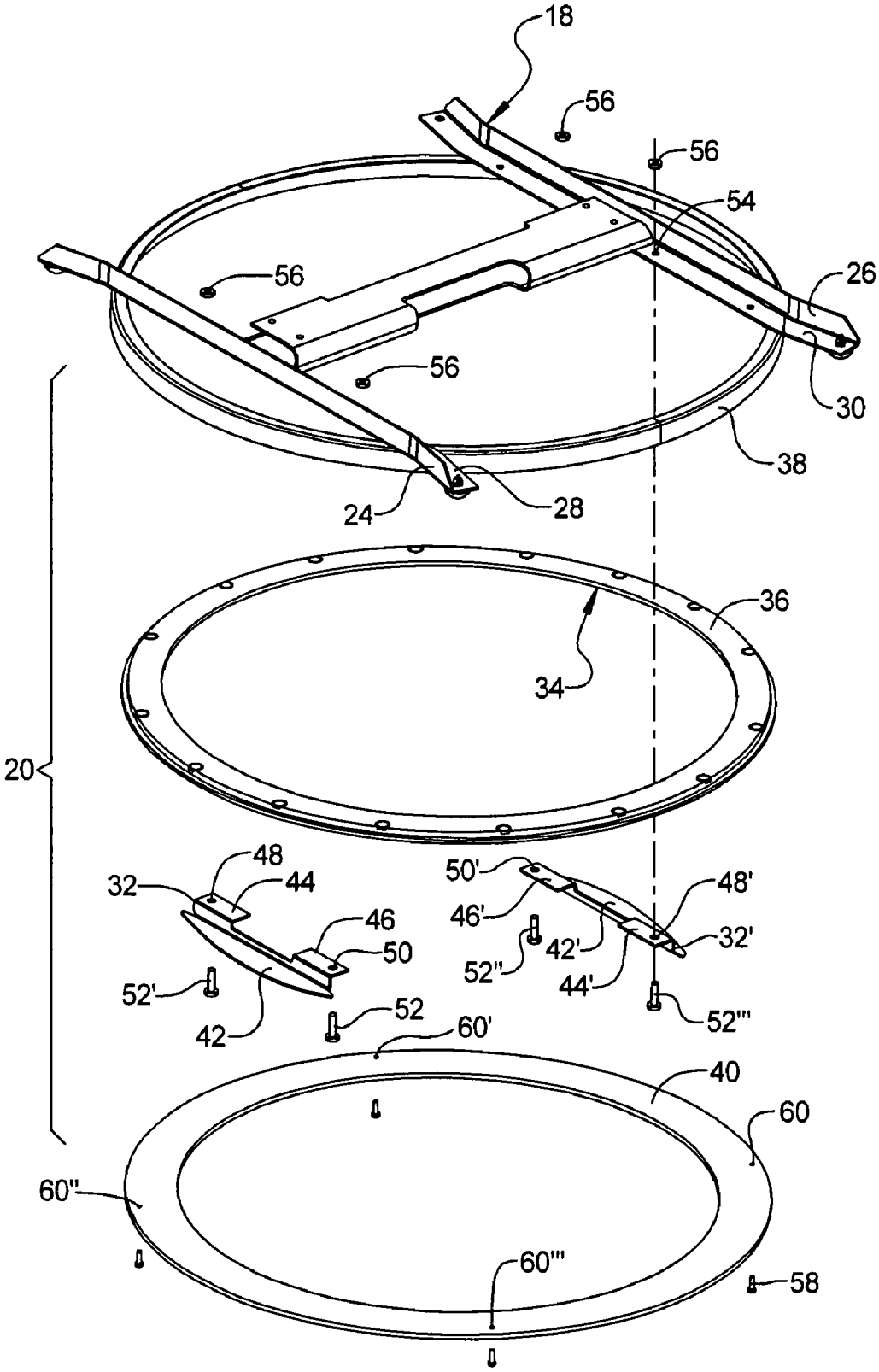
FIG. 3 is a perspective assembly drawing of the components of the swivel base of FIG. 1 with respect to the support frame assembly.

Referring now to FIG. 3, an assembly of swivel base 20 includes each of the first and second support brackets 32, 32' which engage an under surface 34 of a member or bearing ring 36. According to several embodiments, bearing ring 36 is made from a polymeric material. A rotatable member or cap ring 38 is disposed over bearing ring 36. Cap ring 38 according to several embodiments is made from a metal material such as steel or aluminum. A third member or lower support ring 40 is fixedly connectable to bearing ring 36. According to several embodiments, lower support ring 40 is also made from a polymeric material. Lower support ring 40 and bearing ring 36 both provide surfaces of contact between swivel base 20 and the floor or ground surface such that lower support ring 40 and bearing ring 36 are non-rotatable when in contact with the floor surface, while cap ring 38 freely rotates with respect to both lower support ring 40 and bearing ring 36.

Each of the first and second support brackets 32, 32' are identical and are oppositely oriented to engage on opposite sides of bearing ring 36 at the under surface 34. First and second support brackets 32, 32' each include a support flange 42, 42', and first and second connecting flanges 44, 46 and 44', 46', each having one of a first fastener aperture 48, 48' or a second fastener aperture 50, 50'. At least one fastener 52 is used to fixedly connect cap ring 38 to support frame assembly 18. According to several embodiments, fasteners 52 are threaded bolt fasteners and four fasteners 52 are received through first and second fastener apertures 48, 48', 50, 50' and inserted through respective fastener receiving apertures 54 provided in each of first and second leg flanges 28, 30 of support frame assembly 18. Individual ones of a plurality of nuts 56 are fastenably engaged with each fastener 52 to complete the installation of each of the first and second support brackets 32, 32'. Fasteners 52 can also be rivets (eliminating the need for nuts 56), pins, or the like. Lower support ring 40 is fastenably engaged at the under-surface 34 of bearing ring 36 using a plurality of fasteners 58 which are individually inserted through individual ones of a plurality of fastener clearance apertures 60 created through lower support ring 40 and threadably engaged with bearing ring 36.

Bearing ring 36 and lower support ring 40 are therefore fixedly connected to each other while cap ring 38 is allowed to rotate with respect to each of bearing ring 36 and lower support ring 40. The connection of first and second support brackets 32, 32' to each of first and second frame legs 24, 26 of support frame assembly 18 prevents release of cap ring 38 with respect to both bearing ring 36 and lower support ring 40, while still permitting rotation of cap ring 38. Connection of support frame assembly 18 to cap ring 38 supports furniture member 10 from cap ring 38 and prevents rotation of support frame assembly 18 with respect to cap ring 38 which will be described in further detail in reference to FIG. 22.

Figure 4:
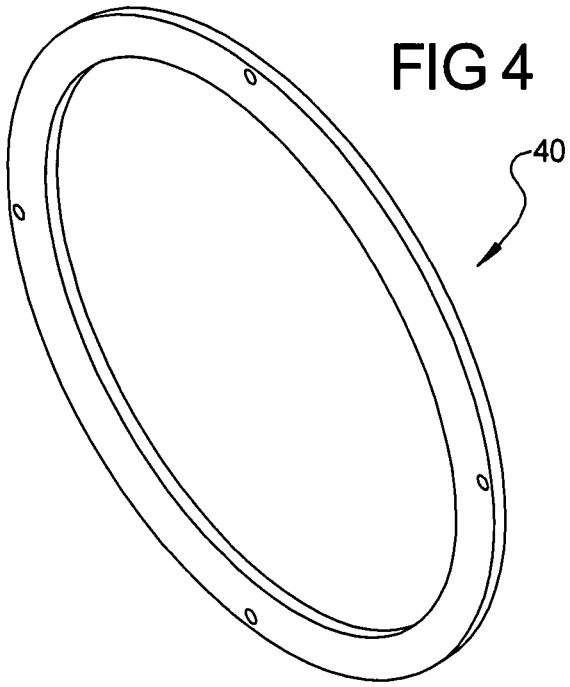
FIG. 4 is a top perspective view of a lower support ring of the swivel base.
Figure 5:
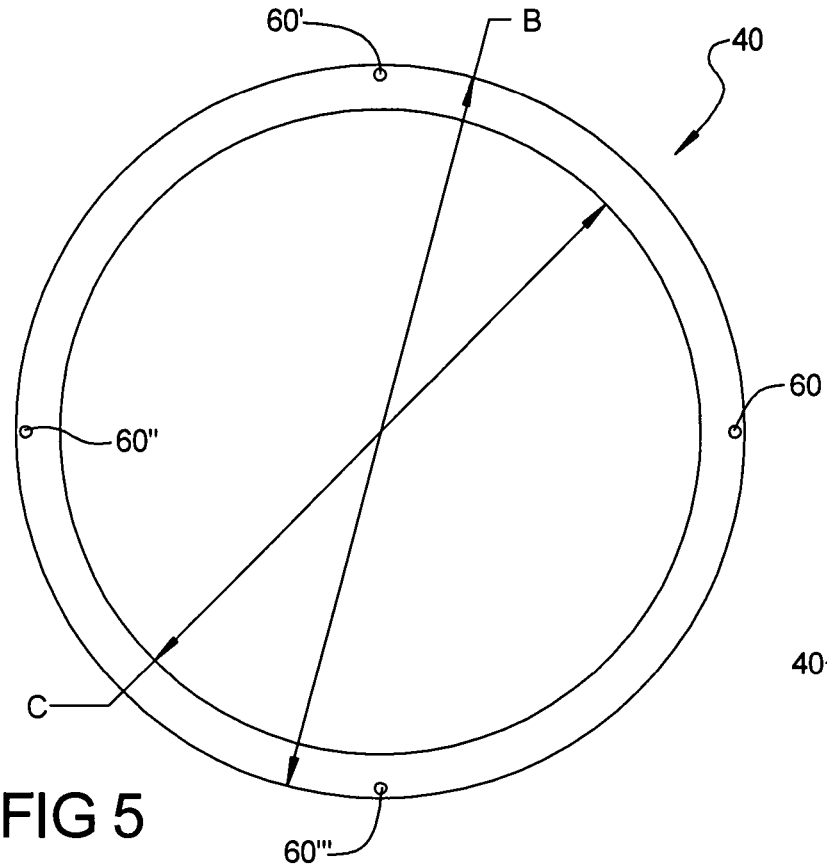
FIG. 5 is a top plan view of the lower support ring of FIG. 4.
Figure 6:
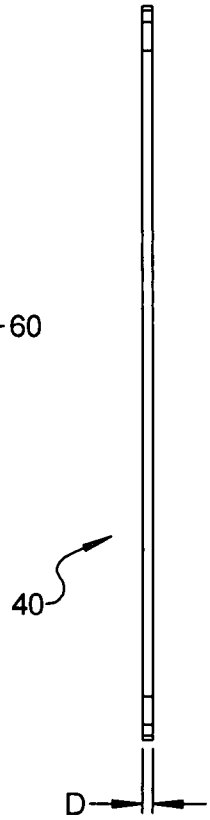
FIG. 6 is a side elevation view of the lower support ring of FIG. 4.

Referring to FIGS. 4 through 6, lower support ring 40 can include four fastener clearance apertures 60, 60', 60", and 60'''. Lower support ring 40 has a support ring outer diameter "B", a support ring inner diameter "C", and a support ring thickness "D". According to several embodiments of the present disclosure, support ring outer diameter "B" is approximately 24.3 in (61.7 cm), support ring inner diameter "C" is approximately 21.25 in (53.9 cm), and support ring thickness "D" is approximately 0.25 in (0.6 cm). Fastener clearance apertures 60 are each oriented equidistantly with respect to each other and therefore are positioned at approximately 90 degree increments. Different quantities of fastener clearance apertures 60 and fasteners 58 can also be used, either less than the identified four or greater than the identified four items. The angular spacing between fastener clearance apertures 60 will therefore depend on their quantity.

Figure 7:
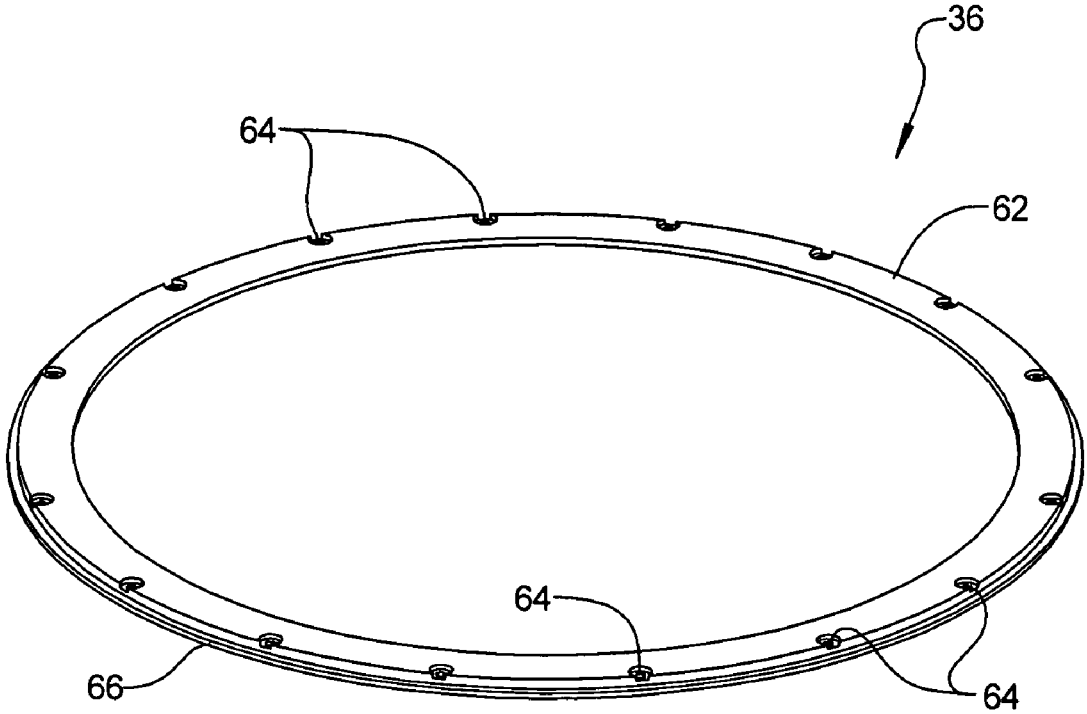
FIG. 7 is a top perspective view of a bearing ring of the swivel base.

Referring to FIG. 7, bearing ring 36 is provided with a plurality of ball bearing support cavities 64 equidistantly separated from each other proximate to an outer perimeter of raised surface ring portion 62. According to several embodiments, a quantity of 16 ball bearing support cavities 64 are provided. This quantity can vary depending upon the diameter of bearing ring 36, the material of bearing ring 36, and the thickness of cap ring 38 which is rotatably supported with respect to raised surface ring portion 62. A radially extending second ring portion 66 is created radially outward of raised surface ring portion 62. Radially extending second ring portion 66 is provided to rotatably receive a portion of cap ring 38 which will be better described in reference to FIG. 21.

Figure 8:
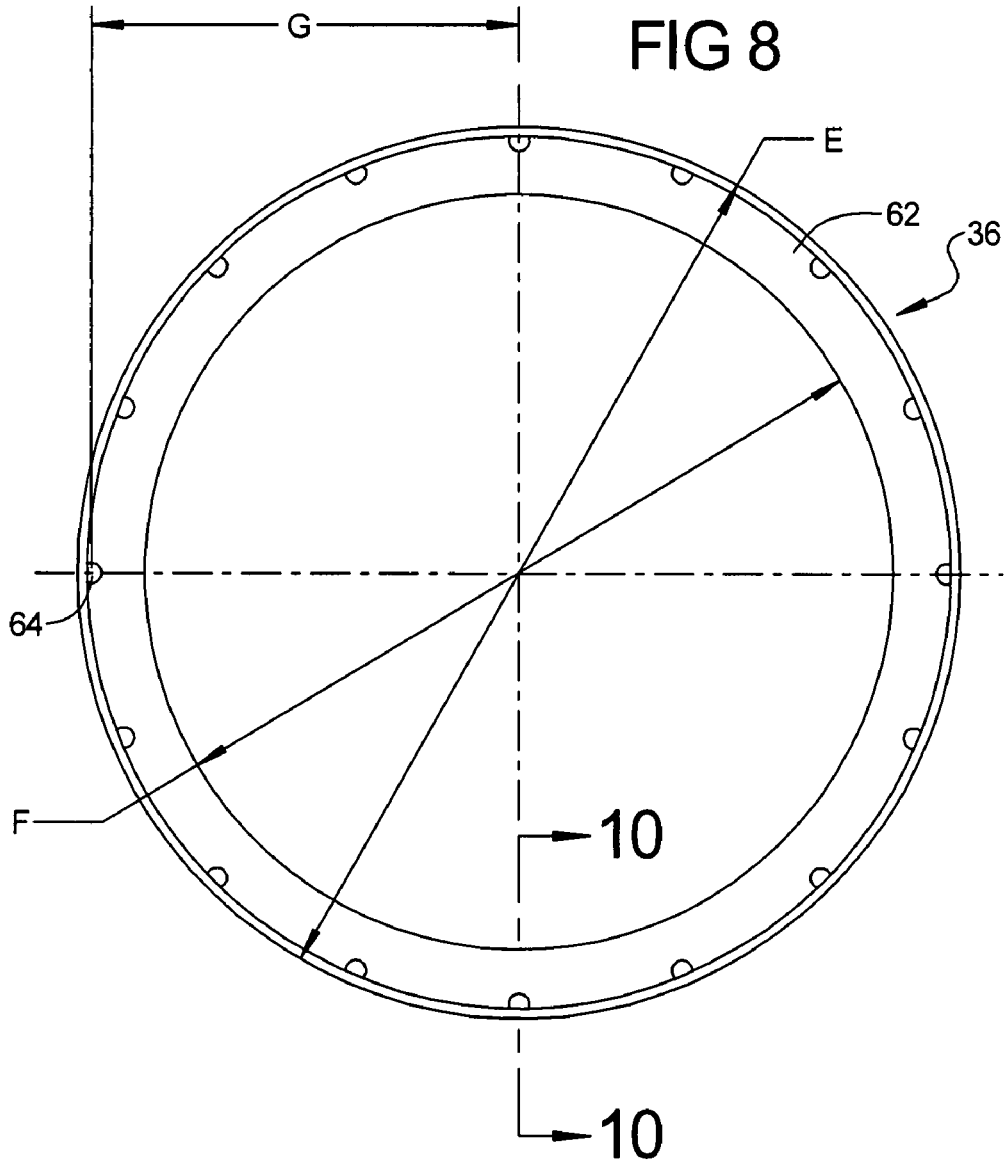
FIG. 8 is a top plan view of the bearing ring of FIG. 4.
Figure 9:
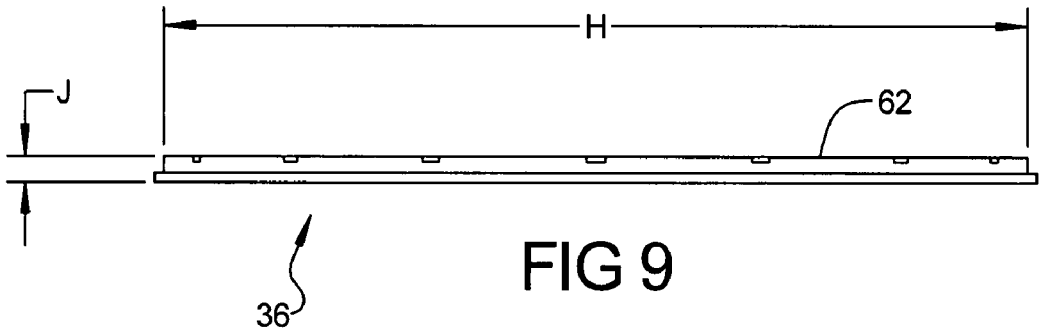
FIG. 9 is a side elevation view of the bearing ring of FIG. 7.

Referring generally to FIGS. 8 and 9, bearing ring 36 has a bearing ring outer diameter "E", a bearing ring inner diameter "F", and cavity spacing dimension "G" defined from a center point of bearing ring 36 to a center of each of the ball bearing support cavities 64, a raised surface diameter "H", and a bearing ring thickness "J". According to several embodiments, bearing ring outer diameter "E" is approximately 26 in (66.0 cm), bearing ring inner diameter "F" is approximately 22.0 in (55.9 cm), cavity spacing dimension "G" is approximately 12.6 in (32.0 cm), raised surface diameter "H" is approximately 25.5 in (64.8 cm), and bearing ring thickness "J" is approximately 0.75 in (1.9 cm). These dimensions can vary at the discretion of the designer or manufacturer and depending on the space envelope of the furniture member 10.

Figure 10:
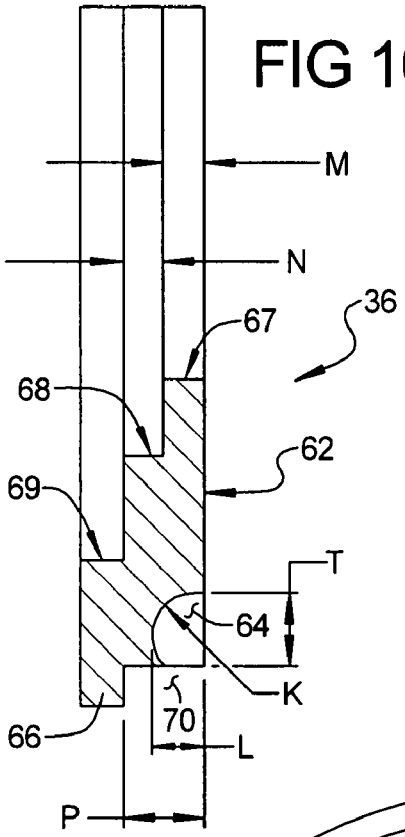
FIG. 10 is a partial cross sectional view taken at section 10 of FIG. 8.

Referring to FIG. 10, a plurality of walls defining radially oriented slots are provided with bearing ring 36. These include an inner diameter wall 67, a first slot wall 68, and a second slot wall 69. Each of the ball bearing support cavities 64 define partial diameter openings to rotatably receive ball bearings which will be described in reference to FIG. 12. Each of the ball bearing support cavities 64 includes a ball bearing cavity radius "K" which according to several embodiments is approximately 0.25 in (0.63 cm). Radially extending second ring portion 66 defines a diametrically formed slot 70 about the outer perimeter of bearing ring 36.

According to several embodiments, a first ring or slot defined by inner diameter wall 67 creates a circular cavity or slot having an inner diameter slot depth "M", measured from raised surface ring portion 62, of approximately 0.25 in (0.63 cm). First slot wall 68 defines a first circular cavity or slot having a first slot depth "N" of approximately 0.25 in (0.63 cm), and second slot wall 69 defines a third circular cavity or slot also having a depth of approximately 0.25 in (0.63 cm). Diametrically formed slot 70 has a slot depth "P" of approximately 0.50 in (1.27 cm).

Figure 12:
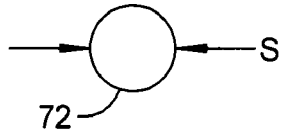
FIG. 12 is an elevational view of a bearing ball of the present disclosure.
Figure 11:
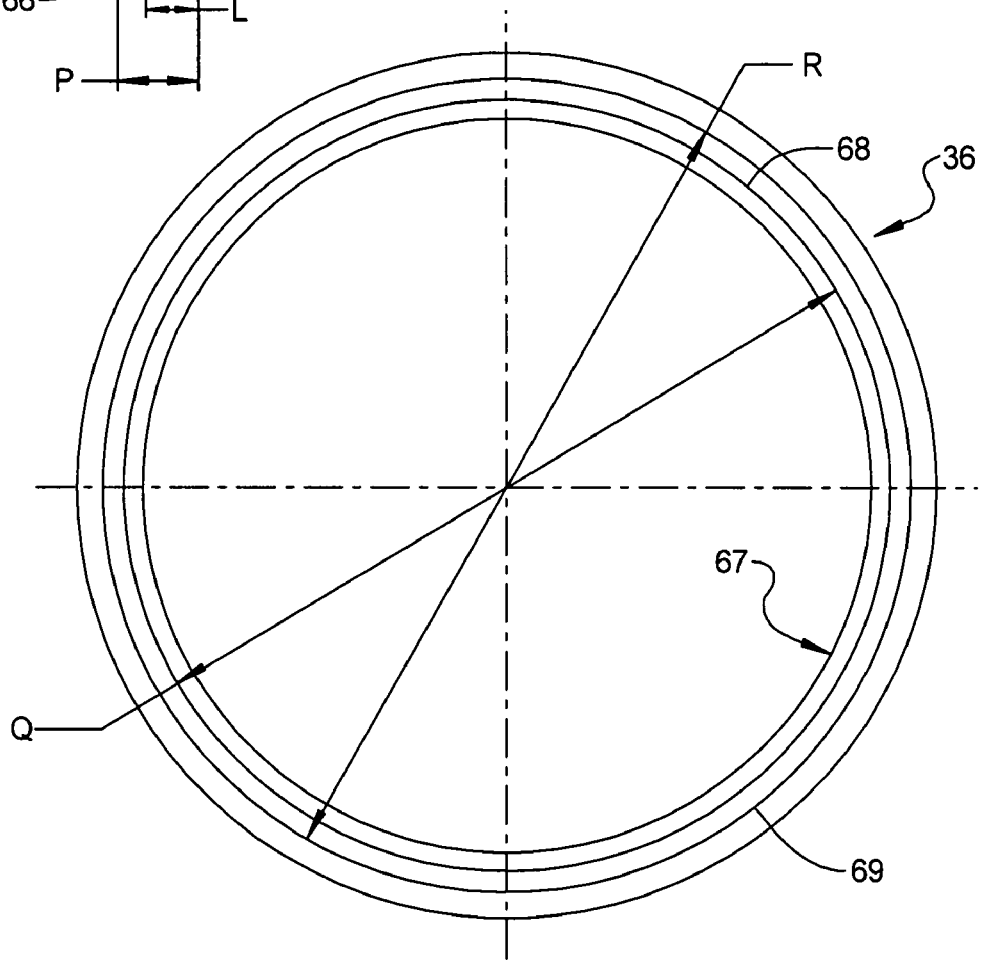
FIG. 11 is a bottom plan view of the bearing ring of FIG. 7.

Referring now to FIGS. 10 through 12, first slot wall 68 defines a slot having a bracket engagement slot diameter "Q" of approximately 23.0 in (58.4 cm) and second slot wall 69 defines a support ring receiving slot diameter "R" of approximately 24.31 in (61.75 cm). Each of the ball bearing support cavities 64 are adapted to receive a ball bearing 72 which according to several embodiments is made from a polymeric material having a ball diameter "S" of approximately 0.5 in (1.27 cm). Ball bearing support cavities 64 further include a cavity width "T" which is less than ball diameter "S", and a cavity depth "L" of approximately 0.31 in (0.79 cm). Each of the plurality of ball bearings 72 when positioned in ball bearing support cavities 64 will therefore extend partially into diametrically formed slot 70. This is shown and described in better detail in reference to FIG. 21.

Referring now to FIGS. 13 through 15, cap ring 38 defines a substantially L-shaped member having a cap ring outer diameter "U", a cap ring inner diameter "V", a cap ring height "W", and an outer wall thickness "X". A cap ring outer wall 74 is oriented at an angle which is substantially perpendicular to a ball contact ring 76. An inner face 78 of cap ring outer wall 74 will rotatably contact each of the ball bearings 72 when ball bearings 72 are positioned in the ball bearing support cavities 64 of bearing ring 36. A plurality of lugs 80 are fixedly connected for example by welding to an outer face of cap ring outer wall 74. In the example shown, a quantity of four lugs 80 are provided, each equidistantly separated from one another and therefore oriented at approximately 90 degrees intervals from each other. The quantity and therefore the angular spacing of lugs 80 can also vary from the four shown. Each of the lugs 80 includes a lug aperture 82 and at least one attachment leg 84 adapted to fixedly engage lugs 80 to the outer wall of cap ring outer wall 74. Lugs 80 are oriented substantially perpendicular to the orientation of cap ring outer wall 74.

Referring now to FIG. 16, cap ring outer wall 74 is oriented at an angle $\alpha$ defined as substantially perpendicular with respect to a perpendicular plane 85 perpendicularly oriented with respect to a ball contact face 86 of ball contact ring 76. According to several embodiments angle $\alpha$ can range from zero degrees to approximately five degrees. Cap ring outer wall 74 can therefore define an angle with respect to ball contact face 86 ranging from 90 degrees to approximately 95 degrees. The purpose of angle $\alpha$ is to maintain contact between inner face 78 of cap ring outer wall 74 and each of the ball bearings 72 to provide a self-centering capability for cap ring 38 when cap ring 38 is rotatably supported with respect to each of the ball bearings 72 positioned in the ball bearing support cavities 64 of bearing ring 36.

Referring now to FIGS. 17 through 20, each of the first and second support brackets 32, 32' include a flange face 88 defining an arc-shaped portion of support flange 42. A rolled edge 90 is created at a radially outward facing arc-shaped extension of support flanges 42. A support surface 92 can also be provided which extends from an opposite side of support flanges 42 from the side having rolled edge 90 created thereon. First and second fastener apertures 48, 50 are spaced from each other by an aperture spacing "Y" of approximately 7.94 in (20.17 cm). Aperture spacing "Y" is controlled to match a similar spacing between fastener receiving apertures 54 shown in reference to FIG. 3. A connecting flange spacing dimension "Z" is also provided between first and second connecting flanges 44, 46 to provide clearance for biasing member 22 shown in reference to FIG. 2.

Figure 21:
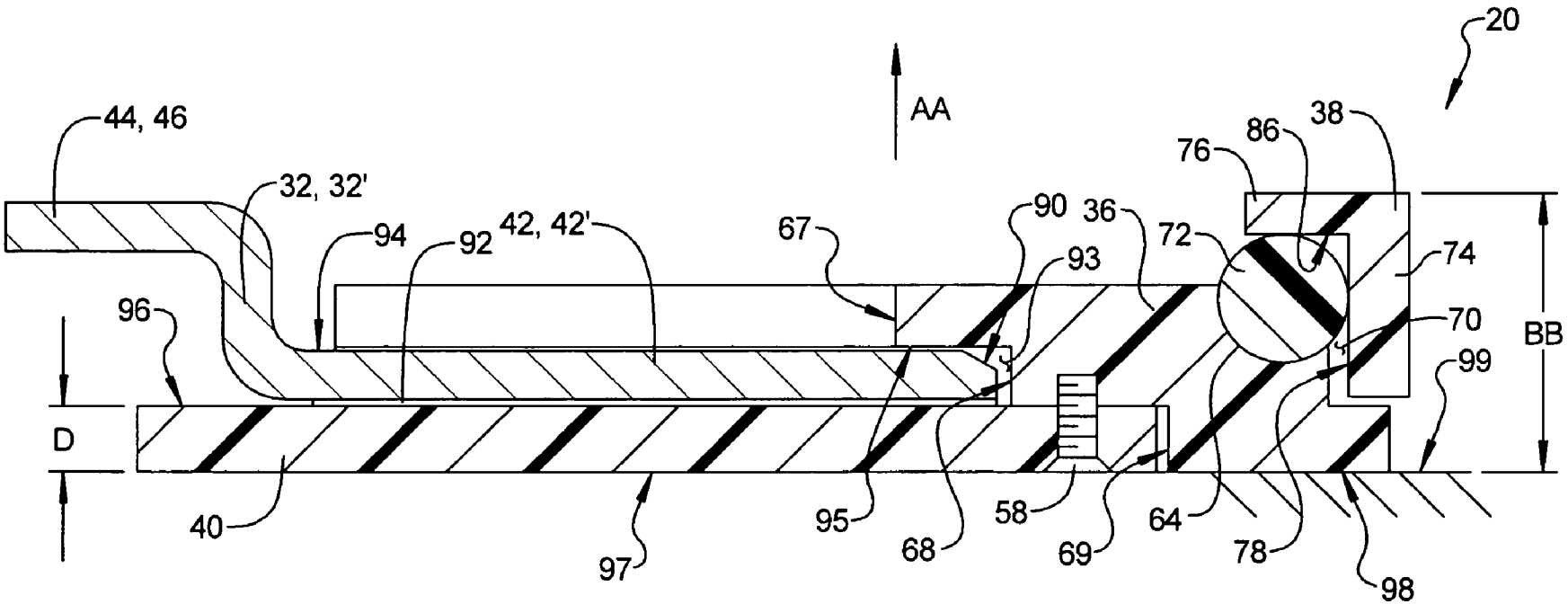
FIG. 21 is a cross sectional side elevational view of an assembly of the swivel bracket and a support bracket of the present disclosure.

Referring now to FIG. 21, each of the first and second support brackets 32, 32' are positioned having support flanges 42, 42' and rolled edge 90 disposed within a slot 93 defined by first slot wall 68. In this position, an upper surface 94 of each of the support flanges 42, 42' contacts and creates an interference with a lower facing edge 95 of bearing ring 36 defined within slot 93. At this same time, support surface 92 contacts an upward facing surface 96 of lower support ring 40 which is positioned within the circular slot defined by second slot wall 69. This interference allows support flanges 42, 42' to resist an upward motion "AA" of first and second support brackets 32, 32' and support frame assembly 18 (not shown) when first and second connecting flanges 44, 46 are connected to support frame assembly 18. A "breaking effect" is also created by the interference which provides a resistance to rotation between cap ring 38 and bearing ring 36 so that furniture member 10 remains in a given location until the resistance is overcome by a rotational effort imparted by an occupant. Use of a polymeric material for bearing ring 36 and lower support ring 40, together with the rounded or tapered shape of rolled edge 90 permit limited sliding motion of first and second support brackets without scratching either of bearing ring 36 or lower support ring 40 and eliminates the need for a lubricant at the areas of contact between bearing ring 36 and lower support ring 40, and first and second connecting flanges 44, 46.

Lower support ring 40 is fastenably connected to bearing ring 36 using fasteners 58 (connection of one fastener 58 is shown). The thickness "D" of lower support ring 40 is substantially equal to a depth of the circular slot defined by second slot wall 69. A downward oriented face 97 of lower support ring 40 is therefore positioned substantially flush or even with a lower face 98 of bearing ring 36. This permits the entire surface of face 96 and lower face 98 to contact a ground or floor surface 99 upon which swivel base 20 is supported. Lower support ring 40 also creates a barrier seal preventing carpet fiber or other floor covering material from becoming lodged between the first and second support brackets 32, 32' and lower facing edge 95 of bearing ring 36 during rotation of swivel base 20 and furniture member 10.

With each of the plurality of ball bearings 72 positioned in the plurality of ball bearing support cavities 64, cap ring 38 can be positioned as shown having ball contact face 86 of ball contact ring 76 rotatably supported by each of the ball bearings 72. Cap ring outer wall 74 is positioned substantially within diametrically formed slot 70 such that inner face 78 of cap ring outer wall 74 is also in contact with each of the ball bearings 72. When supported in the manner shown by each of the ball bearings 72, cap ring 38 is therefore free to rotate with respect to both bearing ring 36 and lower support ring 40. Physical contact between rolled edge 90 and inner diameter wall 67 is minimized or avoided allowing free rotation of first and second support brackets 32, 32' which are fixedly connected to support frame assembly 18 as well as cap ring 38.

Figure 22:
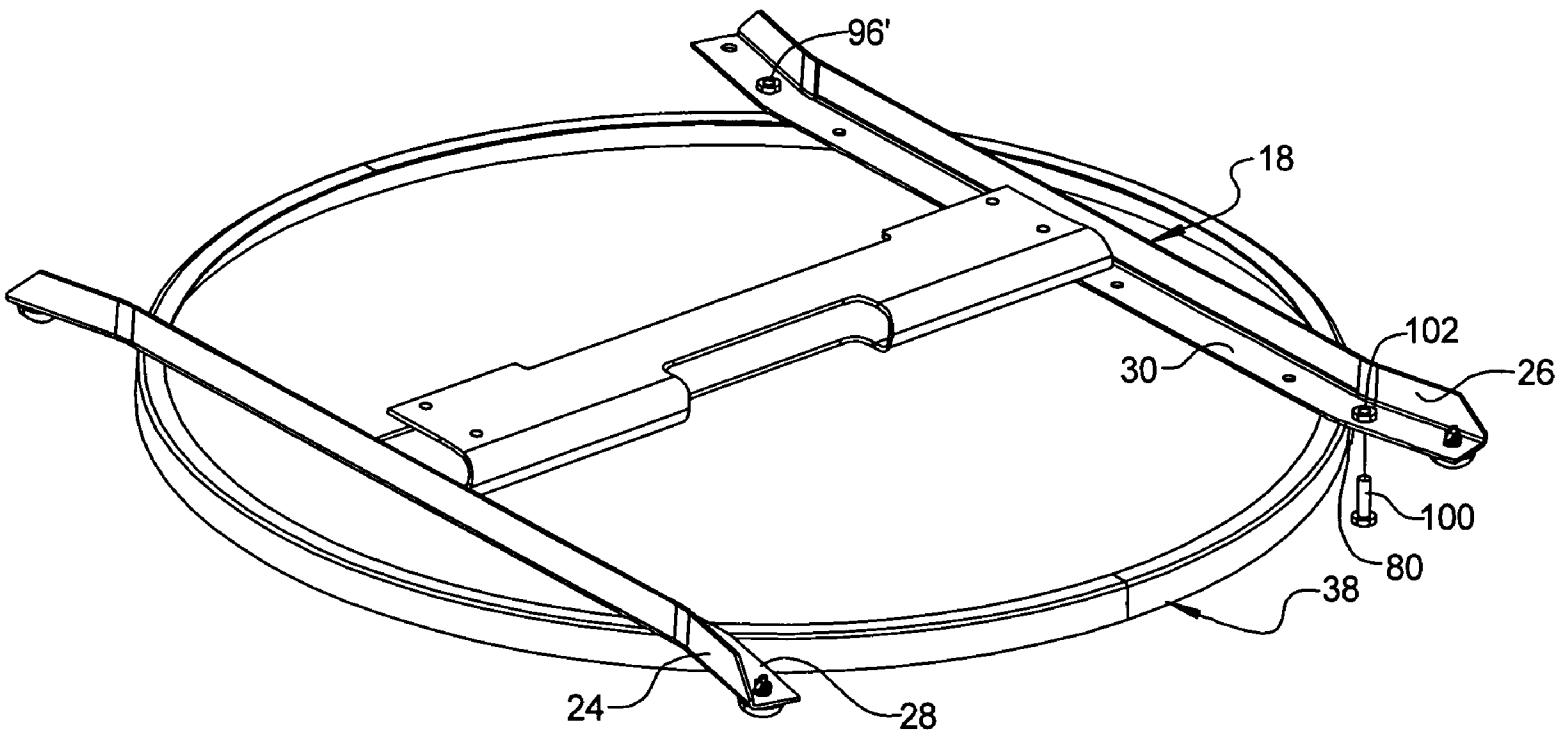
FIG. 22 is a front perspective view of the assembly of support frame assembly 18 with cap ring 38.

Referring to FIGS. 1 and 22, support frame assembly 18 is fastenably connected to cap ring 38 using a plurality of fasteners 100 inserted through apertures created in each of first and second leg flanges 28, 30 of first and second frame legs 24, 26. Each of the fasteners 100 are inserted through one of the lug apertures 82 (not shown) of the lugs 80, through the aperture created through one of the first and second leg flanges 28, 30, and threadably received by one of a plurality of fastener nuts 102. According to several embodiments support frame assembly 18 is fastenably connected to swivel base 20 using four fasteners 100. It is also noted that the placement of lugs 80 on cap ring 38 allow for a connection of fasteners 100 to fastener nuts 102 outside the perimeter of cap ring 38, therefore simplifying the installation of support frame assembly 18 to cap ring 38, while maximizing a diameter of swivel base 20 to provide maximum support for furniture member 10 as furniture member 10 is either rotated about swivel base 20, rocked using mechanism 16, or has back support member 14 or a leg rest assembly (not shown) rotated using mechanism 16.

Referring again to FIGS. 1, 2, and 21, a total height "BB" is defined by the first and second members or cap ring 38 and bearing ring 36 in the operating position (having ball bearings 72 installed). The total height "BB" defines a vertical space envelope of swivel base 20. This space envelope occupies some or all of a height envelope of the plurality of feet 33 extending below and connected to the support frame 18. According to several embodiments, because swivel base 20 occupies some or all the height envelope of feet 33, a height impact or additional height added by swivel base 20 to furniture member 10 is limited to approximately ½ inch (1.27 cm).

Swivel bases 20 of the present disclosure are depicted as circular members or rings, however, the circular shape is not limiting. Providing that the ball bearing support cavities 64 are provided in a circular pattern, at least the bearing ring 36 and the lower support ring can be changed to other geometric shapes such as rectangular or oval. Alternate shapes can be used for example if a larger surface area or footprint of the swivel base is desired.

Each of the bearing ring 36, cap ring 38, and lower support ring 40 are "hollow", defined as doughnut-shaped circumferential or other geometrically shaped structures having no central core, and therefore no material in a central region, instead providing all of their material at an outwardly positioned body or perimeter. A hollow structure prevents the weight or load path of furniture member 10 from being directed to a center of the swivel base 20 which is inherently unstable when supporting the shifting weight of an occupant and mechanism 16. Per the present disclosure, the weight or load of the applicant, furniture member 10, and mechanism 16 are distributed outwardly about the perimeter of swivel base 20. Also, by distributing each of the ball bearings 72 proximate to the outer perimeter of swivel base 20, the load is distributed through the ball bearings 72 outwardly of a center of gravity of furniture member 10 in each of its operating positions.

A swivel base 20 of the present disclosure provides several advantages. By permitting installation of swivel base 20 using four and possibly fewer fasteners 52 to connect to support frame assembly 18, a swivel base 20 can be retroactively back-fitted as an "add on" feature to multiple types of furniture members 10, without change or alteration to the furniture member 10. Swivel bases 20 can also be back-fit onto glider bases of gliding type furniture members 10. Because swivel base 20 occupies a portion of the height of a standard foot member, the total height impact of swivel base 20 is approximately one-half inch. Therefore, the total height of the furniture member is minimally impacted by addition of swivel base 20, allowing operation by the same size range of occupants. By increasing the diameter of the swivel base of the present disclosure to a range of approximately 24 to 26 inches, the footprint provided by swivel base 20 is approximately three times larger than a footprint provided by swivel bases known in the art. This provides the capability of supporting the changing center of gravity of an occupant when the furniture member has extendable elements such as leg rest assemblies and rotatable back support members.

A swivel base 20 of the present disclosure is also diametrically large enough to provide support for a furniture member having a wall proximity mechanism as well. The fastening system provided between the support frame assembly 18 and a swivel base of the present disclosure provides for rapid installation using four fasteners allowing initial installation or back-fit of swivel bases of the present disclosure on furniture members of multiple designs, including but not limited to rocking mechanisms, extendable leg rest mechanisms, rotatable back support member mechanisms, wall proximity mechanisms, and mechanisms adapted to allow a gliding motion of furniture member 10. By positioning the swivel bases of the present disclosure directly in contact with a floor surface, rotation of the members in contact with the floor surface is prevented while the height of the furniture member is controlled. The floor surface contact members of swivel base 20 are provided of polymeric material to avoid scratching hard floor surfaces, to reduce total unit costs, and to reduce swivel base weight compared to a comparably sized all metal swivel base. Also, by positioning swivel bases of the present disclosure below the furniture member support frame assembly, the size of the swivel member is not limited to the envelope of the mechanism, which allows a size increase operable to accommodate the moment arm generated when an occupant rocks, extends a leg rest, or moves the furniture member away from an upright wall-proximity position.

What is claimed is:

1. A swivel base for a furniture member, comprising:

hollow first and second rings and a plurality of ball bearings positioned between the first and second rings to operably permit the first ring to rotate with respect to the second ring, wherein the first ring is fixedly connected to a furniture member such that the furniture member is supported on the first ring, the furniture member and the first ring being rotatable with respect to the second ring when the second ring is non-rotatably in contact with and supported on a floor surface;

a hollow third ring received in a slot created in the second ring, the third ring fixedly connected to the second ring and operable with the second ring to support the swivel base in contact with the floor surface; and the second ring further includes a plurality of ball receiving cavities positioned equidistantly from each other proximate to a perimeter of the second ring and facing the first ring, each of the ball receiving cavities rotatably receiving one of the ball bearings.

2. The swivel base of claim 1, wherein the third ring has a circular shape having an outer diameter received in an inner diameter of the slot created in the second ring.

3. The swivel base of claim 1, further comprising first and second support brackets each having a flange positioned below the second ring and having first and second connecting flanges fixedly engageable to a support frame assembly of the furniture member.

4. The swivel base of claim 1, wherein the first ring further includes:

a perimeter wall; and a ball contact ring resting on and supported by the plurality of ball bearings;

wherein the perimeter wall is connected to and oriented at an angle with respect to the ball contact ring, the perimeter wall and the ball contact ring both in contact with the plurality of ball bearings, the perimeter wall also centering the first ring with respect to the second ring.

5. The swivel base of claim 4, wherein the angle is measurable with respect to a plane extending perpendicularly from the ball contact ring, the angle ranging from zero to approximately 5 degrees inclusive.

6. The swivel base of claim 4, further comprising:

at least one lug fixedly connected to the perimeter wall of the first ring, the lug permitting the first ring to be fastened to the furniture member; and a fastener insertable through an aperture created in the at least one lug and fixedly engaging the first ring to a support frame assembly of the furniture member.

7. The swivel base of claim 1, wherein the first ring is a metal material and each of the second and third rings and the ball bearings are made of a polymeric material.

8. A swivel base for a furniture member, comprising:

a hollow first member having walls defining an L-shape, the walls including an outer wall oriented substantially vertically in an operating position and a ball contact wall oriented substantially horizontally in the operating position;

a hollow second member having a plurality of ball bearing support cavities proximate to an outer perimeter of the second member, the second member positioned below the first member in the operating position; and a ball bearing rotatably received in each of the ball bearing support cavities and extending partially above the second member to rotatably support the ball contact wall of the first member and permit the first member to rotate with respect to the second member;

wherein the first member is fixedly connected to a furniture member, with the furniture member supported on the first member, the furniture member and the first member being rotatable about an axis oriented substantially transverse to the second member with the second member non-rotatably in contact with and supported on a floor surface; and wherein the second member includes a diametrically formed slot positioned radially outward of the cavities, the slot rotatably receiving the outer wall with the outer wall in contact with each ball bearing.

9. The swivel base of claim 8, further comprising:

at least one lug fixedly connected to the outer wall of the first member, the lug permitting the first member to be fastened to the furniture member; and a fastener insertable through an aperture created in the at least one lug and fixedly engaging the first member to a support frame assembly of the furniture member.

10. A swivel base for a furniture member, comprising:

hollow first and second rings and a plurality of ball bearings positioned between the first and second rings to operably permit the first ring to rotate with respect to the second ring, wherein the first ring is fixedly connected to a furniture member such that the furniture member is supported on the first ring, the furniture member and the first ring being rotatable with respect to the second ring when the second ring is non-rotatably in contact with and supported on a floor surface; and first and second support brackets each having a flange positioned below the second ring and having first and second connecting flanges fixedly engaged to a support frame assembly of the furniture member;

wherein the flange of each of the first and second support brackets includes a rolled edge positioned proximate to a slot wall created in the second ring.

11. A swivel base for a furniture member, comprising:

a hollow first member having walls defining an L-shape, the walls including an outer wall oriented substantially vertically in an operating position and a ball contact wall oriented substantially horizontally in the operating position;

a hollow second member having a plurality of ball bearing support cavities proximate to an outer perimeter of the second member, the second member positioned below the first member in the operating position; and a ball bearing rotatably received in each of the ball bearing support cavities and extending partially above the second member to rotatably support the ball contact wall of the first member and permit the first member to rotate with respect to the second member;

wherein the first member is fixedly connected to a furniture member, with the furniture member supported on the first member, the furniture member and the first member being rotatable about an axis oriented substantially transverse to the second member with the second member non-rotatably in contact with and supported on a floor surface; and a circular-shaped third member received in a circular-shaped slot created in the second member, the third member fixedly connected to the second member and positioned together with the second member in non-rotatable contact with the floor surface.

* * * * *